US007418904B2

(12) United States Patent
Illesi

(10) Patent No.: US 7,418,904 B2
(45) Date of Patent: Sep. 2, 2008

(54) INERT BALLISTIC ELEMENT AND PROCESS OF MANUFACTURE

(75) Inventor: Giuliano Illesi, Sarcedo (IT)

(73) Assignee: I.M.Z. S.p.A., Zané (VI) (IT)

( * ) Notice: Subject to any disclaimer, the term of this patent is extended or adjusted under 35 U.S.C. 154(b) by 90 days.

(21) Appl. No.: 11/330,862

(22) Filed: Jan. 12, 2006

(65) Prior Publication Data

US 2006/0243154 A1 Nov. 2, 2006

(30) Foreign Application Priority Data

Jan. 17, 2005 (IT) ..... VI2005A0010

(51) Int. Cl.
*F42B 8/00* (2006.01)
*F42B 30/00* (2006.01)

(52) U.S. Cl. ..... 102/444; 102/498; 102/529; 86/54

(58) Field of Classification Search ..... 102/501, 102/503, 509, 444, 449, 452, 463, 529; 86/54, 86/55

See application file for complete search history.

(56) References Cited

U.S. PATENT DOCUMENTS

| | | | | |
|---|---|---|---|---|
| 2,321,345 | A * | 6/1943 | Whipple | 86/55 |
| 2,327,950 | A * | 8/1943 | Whipple | 102/507 |
| 2,365,708 | A | 12/1944 | Landen et al. | |
| 2,920,374 | A * | 1/1960 | Lyon | 86/53 |
| 2,925,276 | A * | 2/1960 | Leclerc | 473/569 |
| 3,442,205 | A | 5/1969 | Stadler et al. | |
| 3,463,047 | A | 8/1969 | Germershausen | |
| 4,660,263 | A * | 4/1987 | Kosteck | 86/55 |
| H0489 | H * | 7/1988 | Brodman et al. | 102/503 |
| 2002/0056395 | A1 | 5/2002 | Gatti | |

FOREIGN PATENT DOCUMENTS

| | | | |
|---|---|---|---|
| EP | 1193469 | A | 4/2002 |
| FR | 1100960 | A | 9/1955 |
| FR | 2154359 | A | 5/1975 |
| JP | 10249459 | A | 12/1998 |
| JP | 2003200241 | A | 11/2003 |
| WO | 2005003677 | A2 | 1/2005 |

* cited by examiner

*Primary Examiner*—Bret Hayes
(74) *Attorney, Agent, or Firm*—IP Strategies

(57) ABSTRACT

The invention relates to an inert ballistic element and to a method for manufacturing it. Said method comprises the steps of: preparing a cylindrical tube, the ratio between the thickness and the outside diameter of said tube being equal or greater than 0.07; heating one end of the tube for a certain length until it is red hot; forging the end on a forging machine to form the tail and a part of the body of the ballistic element; heating the opposite end of the tube; and performing a second forging operation of the opposite part using a forging mould to form the nose of the ballistic element and to give the ballistic element its final shape. The forging operations are carried out with a forging machine equipped with a chuck that grips the tube by the non-heated end and pushes the tube into each nose or tail mould, which is divided into at least two shells that are moved by an opposite reciprocating motion.

11 Claims, 2 Drawing Sheets

INERT BALLISTIC ELEMENT AND PROCESS OF MANUFACTURE

BACKGROUND OF THE INVENTION

This invention relates to a manufacturing process of an inert ballistic element for military training purposes and to an inert ballistic element manufactured by said process.

It is known that the term "ballistic element" in its most general sense is used to denote any object propelled by firearms or released by self-propelled objects such as missiles, rockets or aircrafts.

It is also known that inert ballistic elements, that is to say, without explosive charge, are used during training or testing manoeuvers to simulate attacks on a target in order to study the ballistic behaviour of the ballistic element without having exploding parts.

The description below refers to a specific type of inert ballistic element consisting of an inert bomb body that is used during training manoeuvres and is dropped from aircrafts.

It will, however, be understood that the invention as described herein may be extended to any other type of inert bomb body and, more generally, to any type of inert ballistic element.

As known, current aircraft bombs substantially reproduce four bomb models manufactured to American standards and identified by the abbreviations MK-81-82-83-84, respectively.

These bombs may be active, that is to say, filled with explosive material, for use in military operations, or inert, that is to say, filled with inert material, used in training or testing.

In both cases, aircraft bombs consist of a bomb body with a fin assembly applied to the tail end and a nose applied to the front end.

In prior art, inert bomb bodies, while differing in their specific realization features, all basically consist of a main hollow body with a nose at the front and a tail ring at the back.

Inside the main hollow body an inert ballast is disposed, consisting of a mixture containing mainly cement, whose purpose is to give the bomb body the same ballistic properties as those of active bomb bodies.

In particular, the main hollow body is made in one or more parts by hot forging a metal tubular element.

This machine process gives the main hollow body the tapered shape required by design specifications which guarantees, also through a gradual variation in wall thickness of the main hollow body, required position of the centre of gravity, of required moment of inertia and of the other ballistic properties.

The main hollow body is then filled with a single inert material, usually a mixture of cement, which, once solidified, forms a single block with the body, so that the body itself has the same weight and ballistic properties as the equivalent active bomb bodies used in military operations.

In particular, the main hollow body of the inert bomb bodies is the same as that used for active bomb bodies which are different from the inert bomb bodies exclusively in the explosive nature of filling material.

Once the main hollow body has been filled through the opening at its back, the opening is closed by a flange screwed to the tail ring.

The outside surface of the bomb body also has the housings for the rings by which the bomb body is suspended from the aircraft.

Prior art bomb bodies of the above type have, however, several well-known disadvantages.

A first disadvantage is that used bomb bodies of this kind cannot be recycled because it is impossible to economically separate the main hollow body made of metal from the cement filling material used to give the inert bomb body the same ballistic properties of those of the active bombs.

As a result, once used the inert bomb bodies known cited must be disposed of in suitable landfills or dedicated sites without recycling and reusing the metal material which the main hollow body is made of, thus increasing operating costs and polluting the environment.

Another well-known drawback is the complexity of the construction process and the length of time needed to fill the main hollow body with the inert cement materials.

More specifically, the cement material, after being filled into the main hollow body, must be allowed to stand for a predetermined length of time so that it can set and become solid.

This invention has for its object to overcome the above mentioned disadvantages.

BRIEF SUMMARY OF THE INVENTION

A first aim of the invention is to provide an inert ballistic element, in particular an inert aircraft bomb body used for training purposes, that is easy and economical to recycle so that the metal material of which it is made can be reused and so that the used ballistic elements do not have to be disposed of in special landfills or dedicated sites.

Another aim of the invention is to provide an inert ballistic element, in particular an inert aircraft bomb body used for training purposes, that simplifies prior art construction technology, making the process for manufacturing the ballistic element quicker and easier.

Yet another aim of the invention is to provide an inert ballistic element which possesses all the ballistic properties of an equivalent ballistic element loaded with explosive, that is to say, which has the same weight, length, shape, centre of gravity and substantially the same moment of inertia.

The above mentioned aims are achieved by an inert ballistic element, the features of which are according to claim 1.

The invention also relates to the method for manufacturing an inert ballistic element, said ballistic element having a hollow body with a central portion of essentially constant diameter, a tapering nose end and a tapering tail end that is slightly smaller in diameter than the diameter of the central portion of said hollow body, where said method, as defined in claim 1, comprises the steps of:

a) preparing a heavy thickness cylindrical tube made of steel whose outside diameter is substantially the same as the diameter of the central portion of said ballistic body and which has a shorter length than the length of said ballistic body and where the thickness of said tube is in relation with said outside diameter with the ratio equal or greater than 0.07;

b) heating one end of said tube at least until it is red hot and for a length at least equal to the length of the tail portion;

c) picking up said heated tube using a manipulator; and d) clamping the unheated end to a chuck on a forging machine;

e) causing said chuck to rotate and pushing said chuck with said heated tube in the direction of the axis of rotation, into a tail end forging mould that is divided into at least two shells;

f) simultaneously with step e), activating said forging machine in order to impart to each of said shells of said tail end forging mould an opposite reciprocating motion so as to repeatedly beat said heated tube during the advancing of said tube in the mould until it has the shape defined by said tail end mould;

g) releasing said shaped tube from said chuck;

h) heating said tube at least until it is red hot on the opposite side of the shaped tail end and for a length at least equal to the length of the nose end;

i) repeating steps c) and d);

l) causing the chuck to rotate and starting to push said chuck with said heated tube in the direction of the axis of rotation, into a nose end forging mould that is divided into at least two shells;

m) simultaneously with step l), activating said forging machine in order to impart to each of said shells of said nose forging mould an opposite reciprocating motion so as to repeatedly beat said heated tube during the advancing of said tube in the mould until it has the shape defined by said nose end mould;

n) unloading the finished element.

The invention also protects the ballistic element made according to the method just described.

Advantageously, according to the invention, the method of hot forging a thick tube allows to provide a finished element without any ballast element.

The finished element therefore consists of a single material, preferably steel, and has the same weight, shape and other ballistic properties of a ballistic element of equivalent size and explosive charge.

It is obvious, therefore, that the ballistic element according to the invention, once used, can be easily recycled since there is no problem to separate different materials because said element is made of one material only.

BRIEF DESCRIPTION OF THE DRAWINGS

Further aims and advantages will become more apparent below from the description of the method for manufacturing the ballistic element according to the invention, with reference to the accompanying drawings, where.

DETAILED DESCRIPTION OF THE INVENTION

Figure 1:
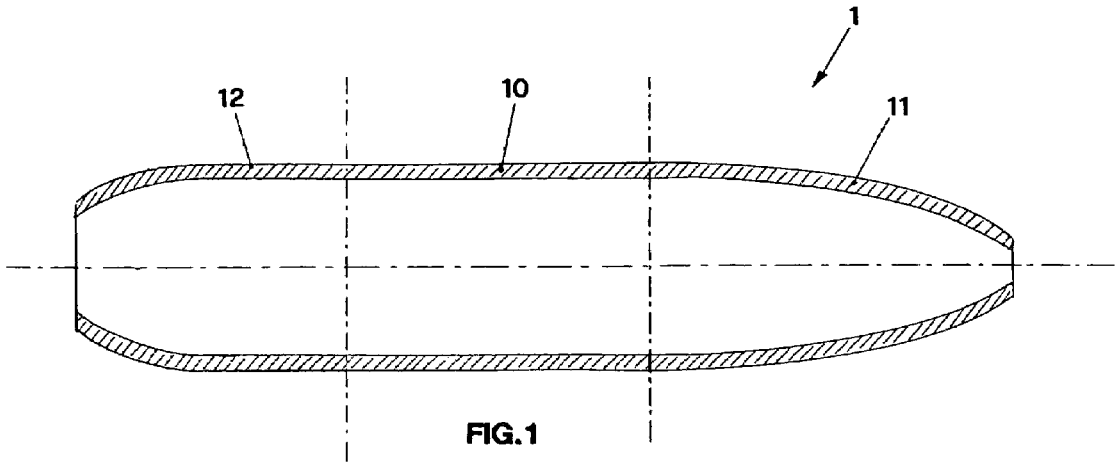
FIG. 1 is a cross section of the ballistic element to be made using the method according to the invention showing the element without the fin assembly at the tail end and the tip at the nose end.

As already mentioned, the object of the invention is to provide an inert ballistic element of the type shown in FIG. 1, denoted in its entirety by the numeral 1.

The ballistic element according to the invention has a central portion 10 of essentially constant diameter, a front portion, also called nose, indicated by 11, with a highly tapered diameter, and a tail portion, indicated by 12, that is slightly smaller in diameter than the diameter of the central portion.

Figure 2:
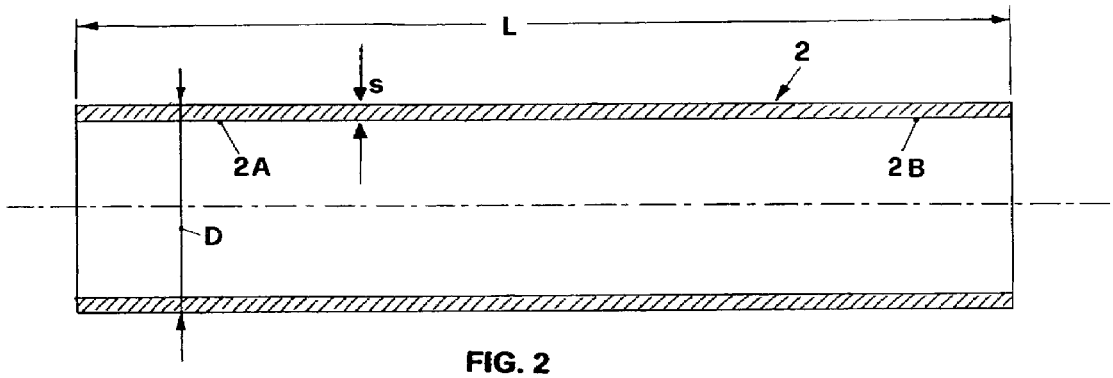
FIG. 2 is a cross section of the thick tube to be processed by hot forging.

In the method according to the invention, the ballistic element indicated by 1 is made from a steel tube shown in cross section in FIG. 2 whose thickness "s" is greater than the thickness of the ballistic element of the same size and weight which is used loaded with explosive.

Obviously, the purpose of the greater thickness is to compensate for the weight of the lacking explosive so that the inert ballistic element has exactly the same shape, weight and other ballistic properties such as centre of gravity and moment of inertia as the equivalent, loaded ballistic element.

The outside diameter "D" of the tube 2 is substantially the same as the diameter of the central body 10 of the finished ballistic element to be made.

The tube is slightly shorter in length "L" than the ballistic element to be made, illustrated in FIG. 1.

The thickness "s" of the tube 2 is in relation with the diameter "D" with the ratio equal or greater than 0.07.

The method proposed by the invention is based on the hot forming of the tube 2 carried out in two successive stages by forging.

The forging in two different stages regards each of the two ends of the tube and an essentially central portion of the tube.

Each forging process requires two different moulds, one for forming the tail end and one for forming the nose end.

In the embodiment being described, each mould consists of two half shells which, when closed, reproduce a part of the shape of the ballistic element to be made. However, each mould might be made in three or more parts.

Figure 3:
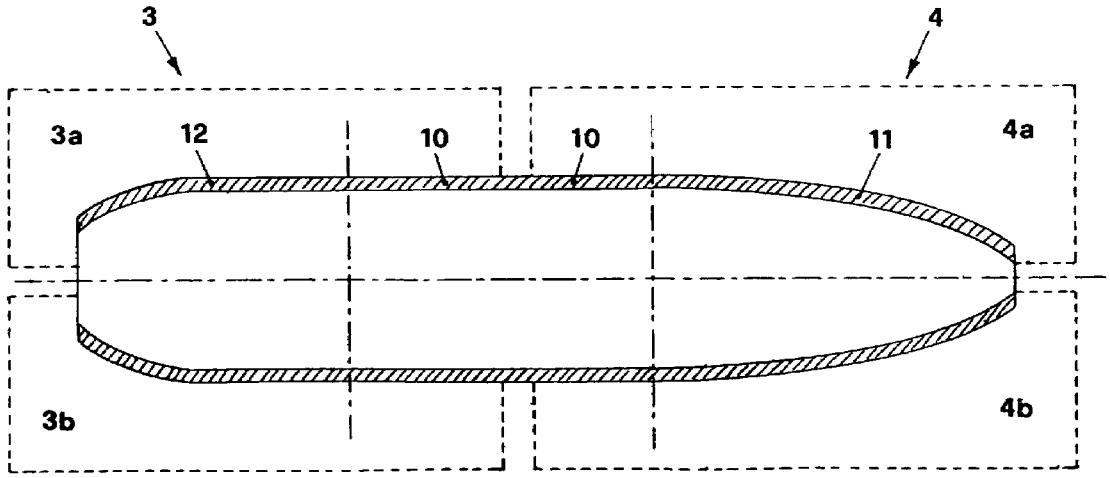
FIG. 3 schematically illustrates the working range of the two moulds used to carry out the method according to the invention.

More specifically, as shown in FIG. 3, the forging mould 3 is divided into two parts 3A and 3B which forge the tail end and part of the central body 10 of the ballistic element.

The forging mould 4, on the other hand, is used to forge the nose end and another part of the central body 10 and, like the mould 3, is also divided into two parts 4A and 4B.

Once the tube 2 of the required length and thickness has been prepared, a section of said tube, including the end that has to be shaped by forging, is heated.

For heating a section of the tube, for example the section 2A, a customary induction heating system may be used.

A heating system of this type makes it possible to focus the heat on a well-defined part of the steel cylindrical tube, making it become red hot very quickly.

However other known heating methods may be also used, for example heating by flame obtained from combustion of natural gas or of LPG or of other combustibles.

Once the required tube section has been heated, the unheated end of the tube, in this case, the end belonging to the section 2B of the tube, is placed, with the aid of a manipulator not shown in the drawings, in a chuck 5 forming part of a forging machine.

Figure 4:
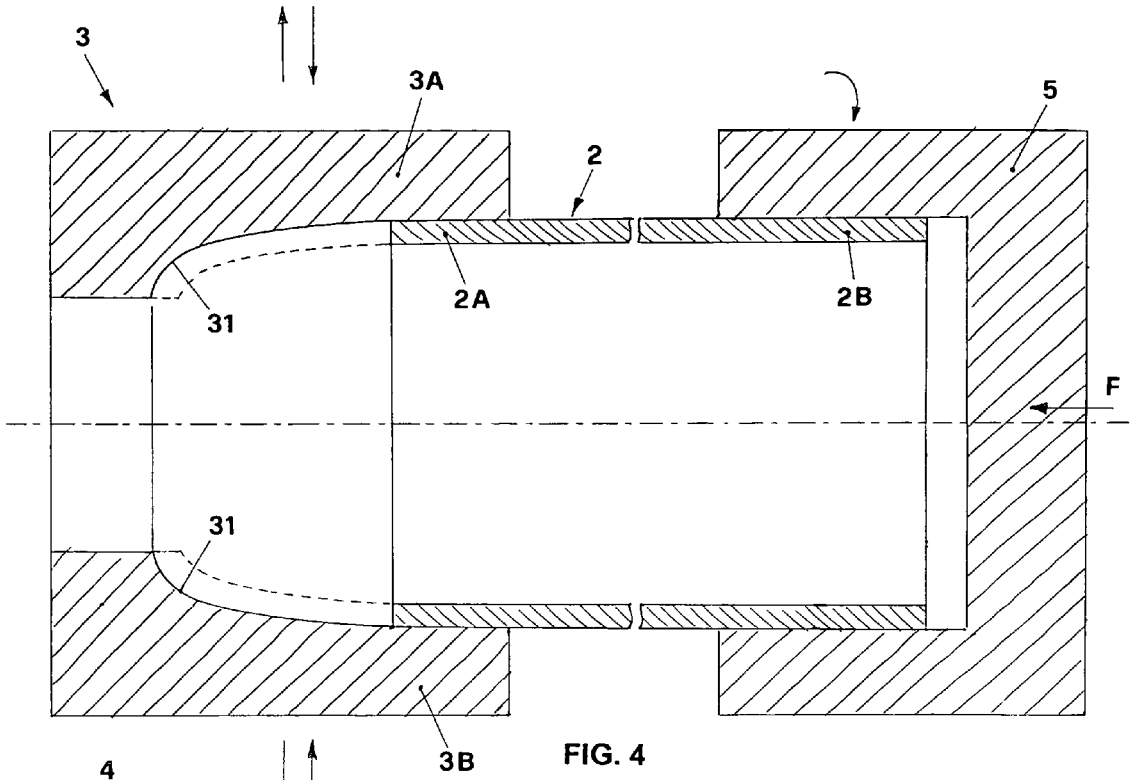
FIG. 4 schematically illustrates the step of forging the tail end of the ballistic element.

Said chuck 5, as shown in FIG. 4, clamps the end 2B of the tube 2 between its jaws and is then made to rotate.

The forging machine used, which is not shown in the drawings, is equipped with proper hydraulic pushers which enable the chuck 5 to exert pressure on the tube 2 in such a way that the latter is gradually forced between the two half-shells 3A and 3B of the mould 3 in direction F.

The two half-shells 3A and 3B are connected to the hammers of the forging machine which imparts to said two halves of the mould an opposite reciprocating motion in such a way as to repeatedly beat the outside heated tube section 2A.

While the tube is being hammered, the chuck 5 continues to push the end 2A of the tube 2 until it reaches the end 31 of the two half-shells of the mould 3.

As it pushes the tube into the mould 3, the chuck 5 rotates continuously so that the shape imparted to the tube is perfectly symmetrical about its axis of rotation.

When the first forging operation has been completed, the two parts 3A and 3B of the mould are opened, the partially forged tube 2 is removed and its shaped tail end allowed to cool down.

The partially shaped tube 2 is now processed again and the end of it opposite the shaped tail end, that is to say, the section 2B that will form the nose end, is heated until it becomes red hot.

Figure 5:
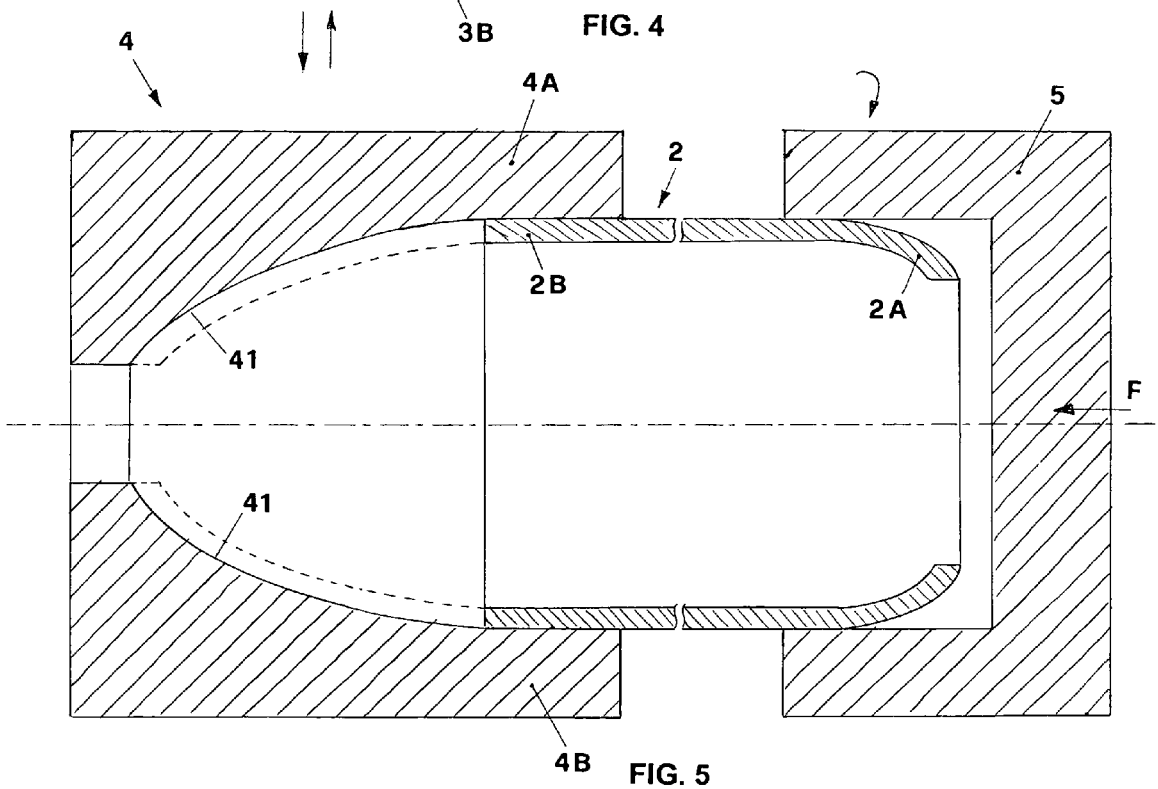
FIG. 5 schematically illustrates the step of forging the nose end of the ballistic element.

A suitable manipulator now positions the shaped tail end corresponding to the tube section 2A between the jaws of the chuck 5, as shown in FIG. 5.

The second forging operation is now performed in much the same way as the one carried out to shape the tail end of the ballistic element.

Thus, the chuck 5 is made to rotate and to push the tube into the nose mould which is also divided into two shells 4A and 4B connected to the hammers of the forging machine.

The shells 4A and 4B, like those of the first mould, are made to reciprocate in such a way as to beat the tube section 2B to be forged while the tube is being advanced towards the end 41.

When the end of the tube 2 has reached the end position 41 of the mould 4, the ballistic element is fully formed.

The ballistic element in its final form and with a thickness made variable by the forging process is thus completed.

However, the shape, weight, centre of gravity and moment of inertia of the ballistic element are identical to the shape, weight, centre of gravity and moment of inertia of a ballistic element of the same shape and size but loaded with explosive.

To make the finished element ready for use, once having fitted it with the necessary fastening means, it will be sufficient to apply to the ballistic element a so called "tail fin assembly" at the back end of it and a "tip" to close the hole of the nose.

Experts in the trade will no doubt appreciate that a finished element as described and made using the method according to the invention is particularly advantageous since it permits quick and easy recovery of the material from which said ballistic element is made, which can thus be recycled and re-used. Indeed, since it is made from a single material, all that has to be done is to melt the material and then use it to make another tube to be forged.

An inert ballistic element identical to the one described above will also be obtained if the nose end is heated and forged before the tail end, that is to say, if the order of the forging operations described above is reversed.

The invention claimed is:

1. An inert ballistic element, consisting of a unitary body that includes a central portion in the form of a cylindrical tube having open ends;

wherein a ratio of a thickness of a sidewall of said tube to an outside diameter of said tube is at least 0.07 to 1; and wherein a weight, center of gravity, and moment of inertia of the inert ballistic element simulate those of an active ballistic element having substantially the same shape, size, and weight, and a thinner sidewall, that is loaded with an explosive material.

2. The inert ballistic element of claim 1, wherein the unitary body is hollow and empty.

3. The inert ballistic element of claim 2, wherein the weight, center of gravity, and moment of inertia of the unitary body simulate those of an active ballistic element having substantially the same shape, size, and weight, and a thinner sidewall, that is loaded with an explosive material.

4. An inert ballistic element, consisting of a hollow, empty unitary body that includes a central portion in the form of a cylindrical tube having open ends;

wherein the inert ballistic element simulates an active ballistic element having substantially the same shape and size and that is loaded with an explosive material, whereby the inert ballistic element has at least one of a weight, a center of gravity, and a moment of inertia that is substantially the same as a respective one of a weight, a center of gravity, and a moment of inertia of the simulated active ballistic element; and wherein a ratio of a thickness of a sidewall of the central portion of the inert ballistic element to an outside diameter of the central portion of the inert ballistic element is greater than a ratio of a thickness of a sidewall of a central portion of the simulated active ballistic element to an outside diameter of the central portion of the simulated active ballistic element.

5. The inert ballistic element of claim 4, wherein the greater ratio of a thickness of a sidewall of the central portion of the inert ballistic element to an outside diameter of the central portion of the inert ballistic element simulates at least one of the weight, the center of gravity, and the moment of inertia of the simulated active ballistic element.

6. The inert ballistic element of claim 4, wherein the ratio of the thickness of the sidewall of the central portion of the inert ballistic element to the outside diameter of the central portion of the inert ballistic element is at least 0.07 to 1.

7. The inert ballistic element of claim 4, wherein the empty unitary body further includes a nose portion adjacent a front end of the central portion, and a tail portion adjacent a back end of the central portion;

wherein an outer diameter of a distal end of the tail portion is smaller than an outer diameter of the central portion;

wherein an outer diameter of the nose portion tapers from a proximal end adjacent the central portion to a smaller distal end; and wherein the outer diameter of the nose portion at the distal end is smaller than the outer diameter of the distal end of the tail portion.

8. A method of fabricating an inert ballistic element, comprising:

determining a shape, size, and weight of an active ballistic element that is filled with an explosive material;

determining a sidewall thickness of a main hollow body of the active ballistic element;

determining an extent to which the sidewall thickness of the main hollow body of the active ballistic element would have to be substantially uniformly increased in order for an empty hollow body having a shape and size that is substantially the same as the shape and size of the active ballistic element to have a weight that is the same as the weight of the active ballistic element that is filled with the explosive material, to provide a compensated thickness value; and fabricating the inert ballistic element as an empty hollow body having substantially the same size and shape as the size and shape of the active ballistic element and having a sidewall thickness that is thicker than the sidewall thickness of the main hollow body of the active ballistic element by an amount that is substantially equal to the compensated thickness value.

9. The method of claim 8, wherein a ratio of the sidewall thickness of the inert ballistic element to an outer diameter of the inert ballistic element is at least 0.07 to 1.

10. The method of claim 8, wherein fabricating the inert ballistic element as an empty hollow body includes providing a cylindrical tube made of substantially the same material as the main hollow body of the active ballistic element and having a sidewall thickness that is thicker than the sidewall thickness of the main hollow body of the active ballistic element by an amount that is substantially equal to the compensated thickness value.

11. The method of claim 10, wherein fabricating the inert ballistic element includes forming the cylindrical tube into the empty hollow body, wherein the empty hollow body has substantially the same size and shape as the size and shape of the active ballistic element.

* * * * *